US006371005B1

(12) United States Patent
Foschini et al.

(10) Patent No.: US 6,371,005 B1
(45) Date of Patent: Apr. 16, 2002

(54) HYDRAULIC POWER UNIT FOR AN ELEVATOR DRIVE

(75) Inventors: Gianluca Foschini, Cervia; Renzo Toschi, Bologna, both of (IT)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/385,750

(22) Filed: Aug. 30, 1999

(51) Int. Cl.[7] ..... F15B 11/08; B66B 1/28; F04B 17/00

(52) U.S. Cl. ..... 91/418; 187/285; 417/423.14; 417/423.3

(58) Field of Search ..... 91/418; 92/1, 144; 60/477, 480, 481; 417/423.8, 423.3, 423.14; 187/285

(56) References Cited

U.S. PATENT DOCUMENTS 3,764,233 A * 10/1973 Strickland ..... 417/414
4,785,915 A * 11/1988 Shah et al. ..... 187/110
5,078,236 A * 1/1992 Shimoaki et al. ..... 187/285
6,029,448 A * 2/2000 Hubson ..... 60/477 X

FOREIGN PATENT DOCUMENTS

| | | |
|---|---|---|
| EP | 0680921 | 5/1995 |
| JP | 02296497 | 10/1990 |
| JP | 07114228 | 5/1995 |
| SE | 332698 | 2/1971 |

* cited by examiner

*Primary Examiner*—John E. Ryznic

(57) ABSTRACT

A vertically oriented hydraulic power unit for an elevator drive includes an outer tank for drive fluid and an inner tank for fluid used to submerge and cool a motor, the fluids being exchangeable to maintain temperature in the inner tank at or below a specified maximum temperature. Oil returning from an elevator piston is fed into said inner tank to keep the inner tank sufficiently cool.

5 Claims, 4 Drawing Sheets

FIG. 3
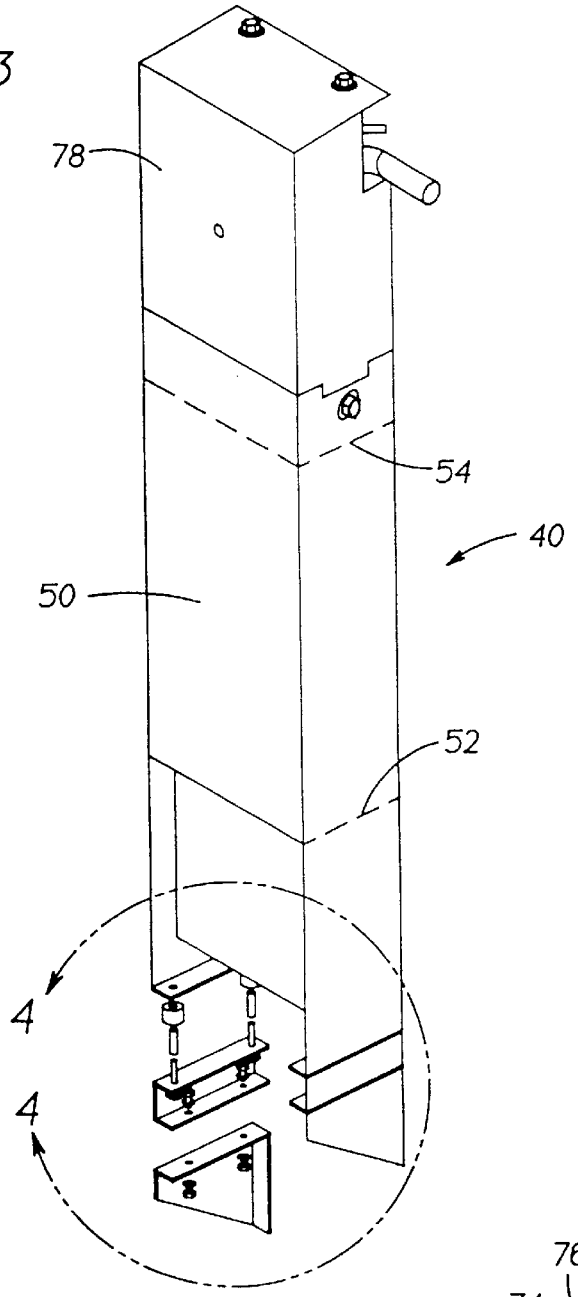
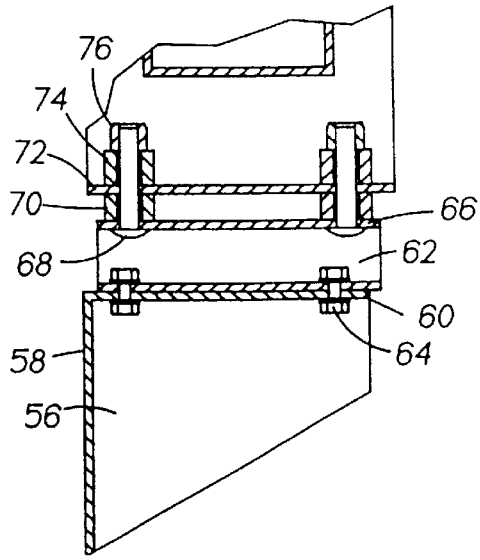
FIG. 4

HYDRAULIC POWER UNIT FOR AN ELEVATOR DRIVE

BACKGROUND OF THE INVENTION

1. Field of the Invention

The invention relates to hydraulic elevators. More particularly, the invention relates to a pump and tank for a hydraulic power unit.

2. Prior Art

Hydraulic elevator systems are popular for lower rise applications since installation cost is generally lower than traction type elevator systems. The car of a hydraulic elevator system is displaced upwardly and downwardly within a hoistway by a piston disposed within a drive cylinder located at the base of the elevator hoistway. In order to provide pressurized fluid to the drive cylinder and, on demand, drive the piston and elevator car connected thereto upwardly, a pump and motor assembly is required. Commonly pump and motor assemblies of the prior art were maintained in a machine room wherein a large horizontally disposed tank contained the pump and motor therewithin and sufficient oil to both drive the elevator car to its highest intended stopping point and still cover the motor and pump. Such tanks are very large because of the amount of oil required to both drive the piston and keep the motor and pump submerged. A benefit of the prior art arrangement is that noise generated by the motor and pump is contained substantially to the machine room and therefore is insulated from the elevator car. Referring to FIG. 1, a prior art hydraulic power unit is illustrated in a schematic machine room. The device 10 is generally mounted upon a type of support 12 within room 14. Tank 16 occupies a large portion of the machine room 14. The motor 18 and pump 20 are illustrated as mounted within tank 16 and are completely submerged in oil 22. It will be appreciated that the minimum oil level is indicated at 24 in the figure. The maximum oil level 26 will illustrate the difference between the oil required to maintain the pump and motor in a submerged condition and the oil required to operate the piston of the hydraulic elevator system. In many configurations more oil is actually required to submerge the motor and pump than is required to run the elevator. Because of this, very large tanks 16 are required to handle the amount of oil. Furthermore, a significant cost is incurred by the reservoiring of so much oil.

Mounted atop tank 16 is a valve block 28 which generally also includes a shut-off valve 30. Valve block 28 is configured to supply low to medium pressure oil at about 12 to 45 bar to the cylinder 32 of the elevator system and allow oil to return to the tank 16 when the elevator car of the elevator system is lowered requiring the bleed-off of pressure from cylinder 32 and piston 34. Since space is an expensive commodity in modem building architecture, machine roomless elevator systems are becoming more accepted and in fact demanded. Because of the size of the hydraulic power unit 10 in a conventional hydraulic elevator system, building a hydraulic elevator system without a machine room has heretofore been nearly impossible. The elevator art is thus in need of a system that allows the hydraulic elevator power unit to be mounted such that a machine room is not required.

SUMMARY OF THE INVENTION

The above-identified drawbacks of the prior art are overcome or alleviated by the hydraulic power unit of the invention.

A novel hydraulic power unit is created by vertically configuring various components of the unit and modifying internal structure of the tank thereof in order to maintain oil levels and temperatures required for motor and pump operation while avoiding the necessity of the large volumes of oil required in the prior art. The invention further provides for cooling of the oil reservoir surrounding the motor and pump. Finally the invention provides an insulated cover for the valve block assembly thus ameliorating the noise transmitted through the valve block.

In the vertical configuration made possible by the present invention, the hydraulic power unit of the invention is rendered significantly more compact than its conventional cousin enabling the fitment of the hydraulic power unit in the hoistway with the elevator car. Preferably, the unit is placed in a clearance space between a wall of the hoistway and side of the elevator car. By allowing for in-hoistway containment of the hydraulic power unit, the need for a machine room is obviated.

Since the invention locates the power unit in the hoistway and the machine room is deleted, a conventional rescue pump is inconvenient to use as it requires a technician or rescue personnel to enter the hoistway to operate the same. The invention therefore includes a rescue pump located more conveniently.

BRIEF DESCRIPTION OF THE DRAWINGS

Referring now to the drawings wherein like elements are numbered alike in the several figures:

FIG. 3 is a perspective exterior view of the hydraulic pump unit of the invention;

FIG. 4 is an enlarged assembled elevation view of a portion of the illustration of FIG. 2 within circumscription line 3—3;

BEST MODE FOR CARRYING OUT THE INVENTION

Figure 1:
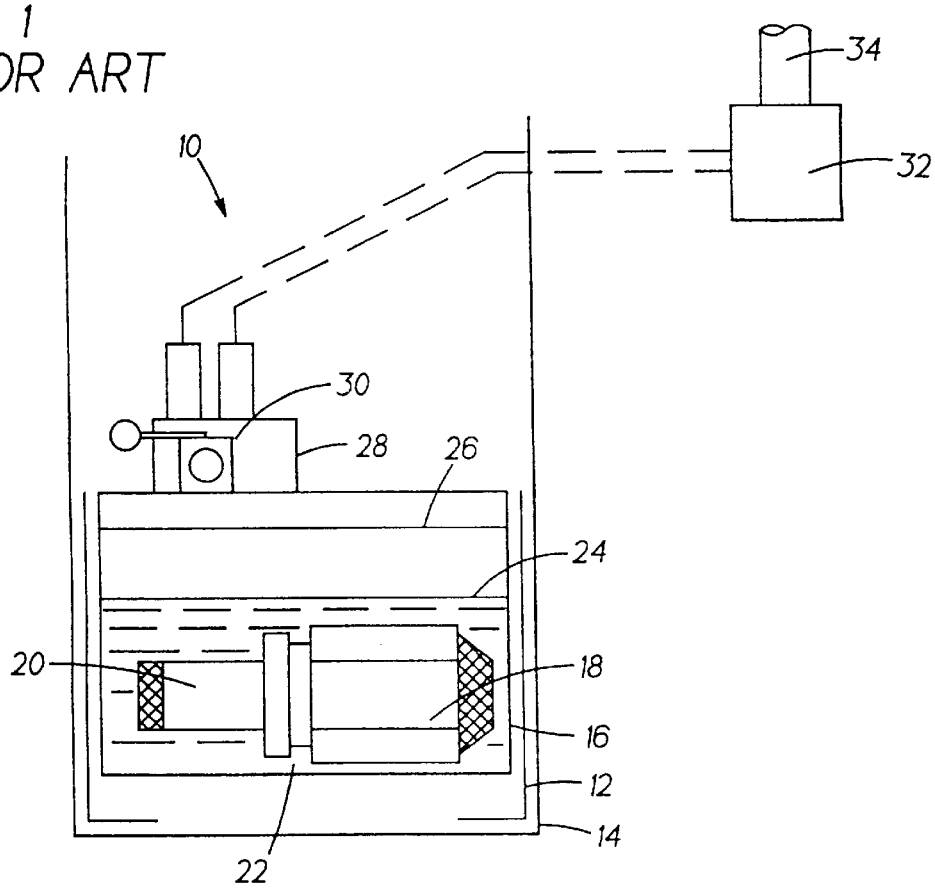
FIG. 1 PRIOR ART
FIG. 1 is a representation of a prior art hydraulic power unit within a machine room.
Figure 2:
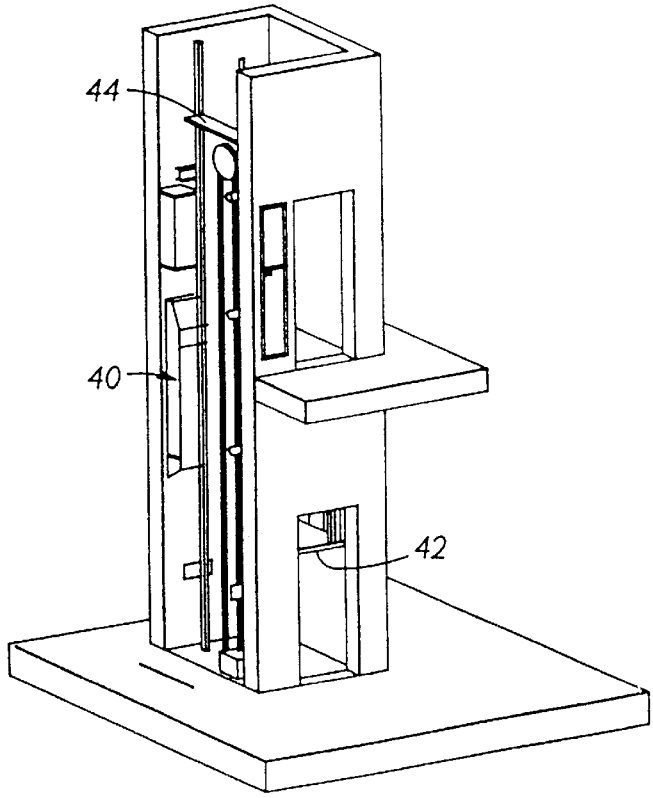
FIG. 2 is a schematic perspective view of a hydraulic elevator system of the invention and illustrating one location for the unit.

The invention enables compliance with market desires and emerging industry regulations by eliminating the need for a machine room in hydraulic elevator systems. Referring to FIG. 2, the invention locates a new hydraulic power unit 40 in clearance space around elevator car 42 and/or framework 44. The car 42 and the piston (not shown) are otherwise conventional. Because of the particular construction and configuration of elements within power unit 40, the unit is small enough to fit in clearance space in the hoistway such as the location in which it is illustrated in FIG. 2. It should be understood that FIG. 2 represents but one possible embodiment, other possible embodiments include placement in other clearance spaces within the hoistway.

Figure 5:
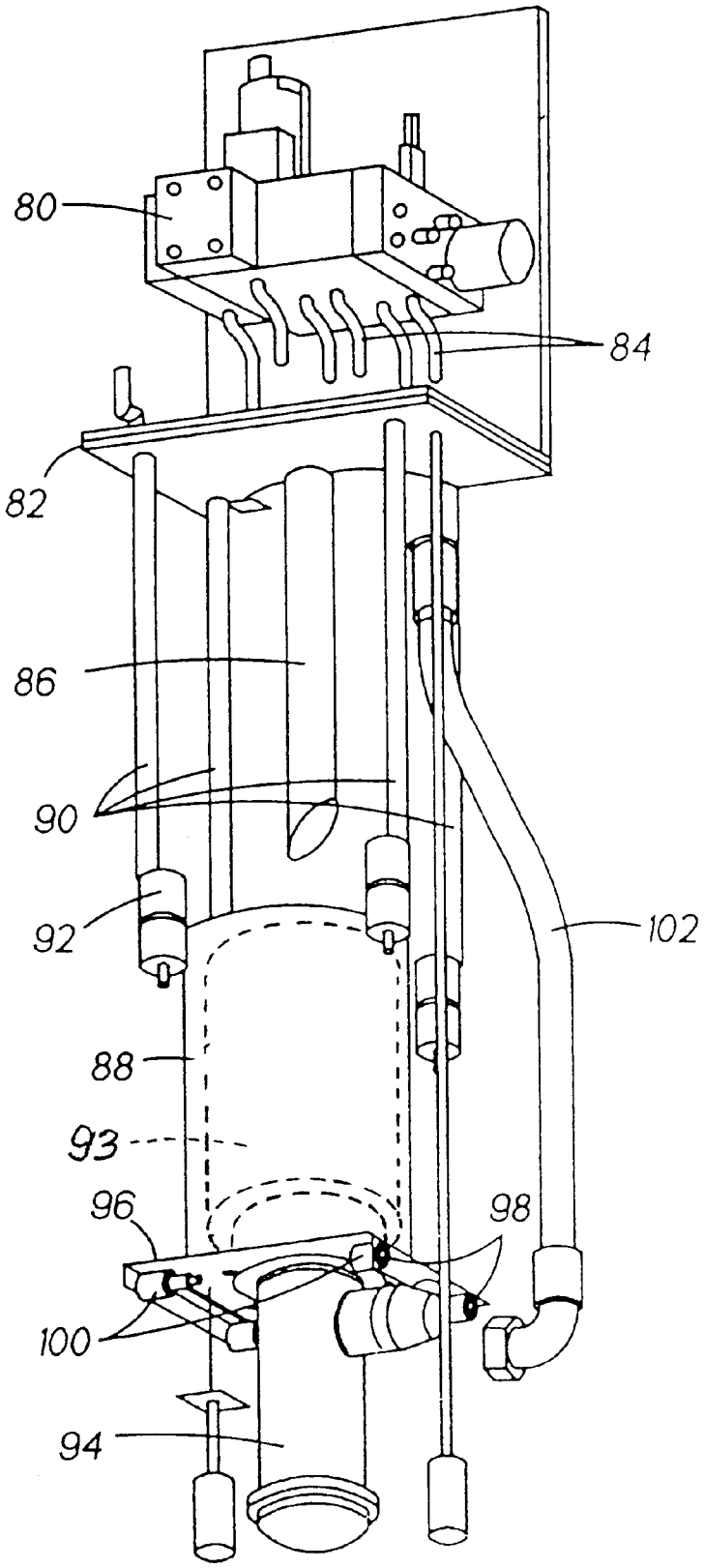
FIG. 5 is a perspective view of the hydraulic pump unit of the invention with the outer housing removed to expose internal parts of the invention.

Referring to FIGS. 3–5, the hydraulic power unit 40 of the invention is illustrated in detail. In FIG. 3, a vertically oriented tank 50 of unit 40 and associated mounting hardware is shown. Tank 50 comprises sheet material, preferably metal, which is bent or otherwise constructed to rest in a preferably rectangular shape and which is sealed at all side and bottom seams so that it will prevent leaking of the hydraulic fluid (oil) contained therein. A minimum level of oil is represented at broken line 52 and a maximum level is represented at broken line 54.

Tank 50 is mounted upon tank suspensions 56 which are preferably fastened to a support structure such as a wall through flange 58. Suspensions 56 provide a further flange 60 which is used to bolt to spacer 62 with fasteners 64 in a preferred embodiment. Spacer 62 is illustrated as a C-channel although it will be understood that other structures may be substituted. Spacer 62 provides a mounting surface 66 through which a fastener 68 extends and upon which a bushing 70 rests. Fastener 68 then extends through a base flange 72 of tank 50. Another bushing 74 is placed upon fastener 68 and then a nut 76 is tightened thereupon. The arrangement is preferred to provide vibration damping for the unit 40 which reduces noise emissions. Further reducing noise emissions are cover 78 which is mounted atop tank 50 and provides noise insulation for a valve block housed herewith.

Referring to FIG. 5, the internal components of unit 40 are illustrated. A valve block 80 is mounted inside of cover 78. Such valve blocks are commercially available from Otis Elevator Company, CEAM via pradazzo N. 4/2, 40012 Calderara di Reno (BO) ITALIA. Block 80 is mounted on plate 82. Plate 82 includes a plurality of orifices for through passage of a plurality of draining pipes 84 which drain oil from piloting valves during operation of the power unit 40. Plate 82 also supports discharge hose 86 which discharges oil from an acceleration spool and a pressure relief valve which are internal to block 80 and known to the art. In discussing FIG. 5 the relative terms "above" and "below" are intended only to relate to the drawing figure and not to imply any limitation to location of components of the invention. Below plate 82 is positioned motor tank 88 which is attached to plate 82 in spaced relation by arms 90. In a preferred embodiment, arms 90 are attached to motor tank 88 with bushings 92 to reduce vibration and associated noise.

Figure 6:
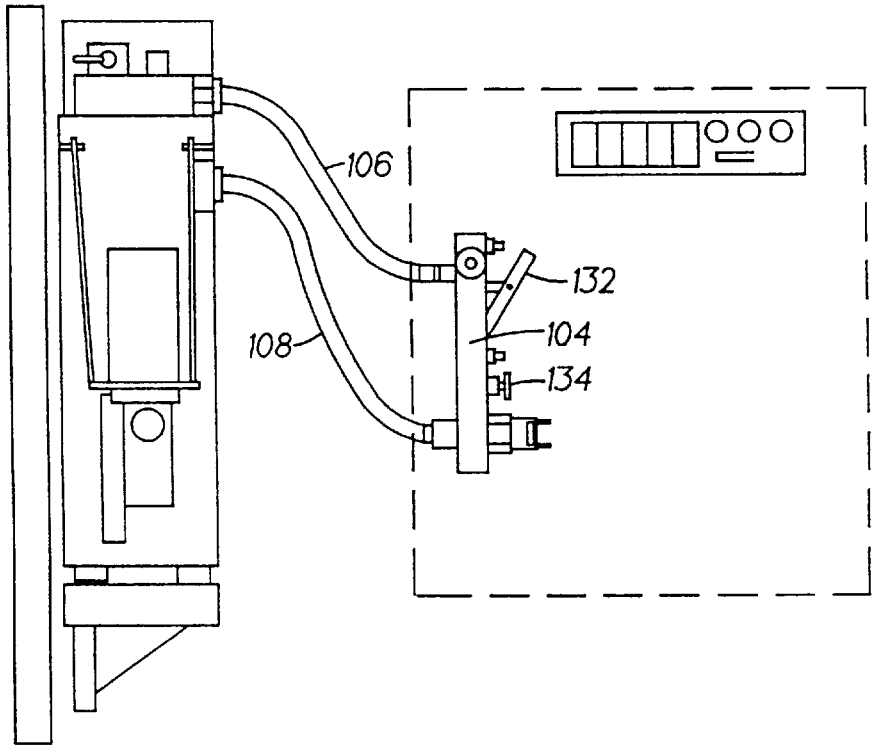
FIG. 6 is a schematic representation of the invention connected to an auxiliary valve block and electronic board in a controller cabinet.

Tank 88 is preferably constructed of sheet metal material and in a preferred embodiment is cylindrical in shape. The tank is sized appropriately to contain the motor 93 being employed for the application so as to maintain the motor immersed in an oil or other hydraulic fluid at all times. The motor is attached to a pump 94 which extends from the bottom of motor tank 88 to the bottom of tank 50 (FIG. 3). Motor tank 88 and plate 82 along with all related components are supported within tank 50 by feet 96 and 98 which are preferably bushed with a vibration absorbent bushing 100. Finally, a high pressure line 102 is visible in the drawing in exploded form which in operation ferrys high pressure fluid from pump 94 to valve block 80. The high pressure fluid (oil) is then distributed to the piston of the elevator through the auxiliary valve block 104 and through line 106 (see FIG. 6). A return line 108 returns fluid from the piston to the tank 50.

Because of motor tank 88, the motor 93 always remains submerged in oil. The oil in the motor tank 88 is cooled by the bleed oil from discharge hose 86 and draining pipes 84 during descent of the elevator car and by bleed oil from the pump into tank 88 during upward movement of the elevator car 42. More specifically, upon an elevator car call, the motor is activated and the pump pressurizes the fluid headed for the piston. Some of this pressurized fluid bleeds from the pump 94 into the motor tank 88 due to the intentional lack of a seal at the interface of the motor 93 and pump 94. Preferably, only a busing is installed at this interface to maintain operating parameters of the pump but to facilitate the bleed. The bleed oil is cooler than the oil in motor tank 88. Since the bleed oil during this phase of operation bleeds in from the bottom of tank 88 and because the oil is cooler, the warmer oil in the motor tank 88 spills over the top thereof. The oil in the motor tank 88 is thus replaced by the cooler bleed oil and cools the motor. During the down operation, bleed off oil from the valve block, as stated above, enters the top of the motor tank 88 thus also cooling the motor. Based upon testing, the temperature of the oil in the motor tank 88 remains at or below 70° C. and the motor (not shown remains at or below 100° C. This is because the bleed oil is cooler than the indicated temperature when introduced to motor tank 88. The oil is cooler because of enviromental cooling thereof in the outer tank and the piston. The operation of the car itself due to wind currents it created in the hoistway assists in the environmental cooling.

The invention allows virtually all of the oil in outer tank 50 to be used to lift the elevator car while still keeping the motor submerged in its own motor tank 88. For this reason, less total oil is necessary and a smaller effective exterior dimension is achieved. Thus the power unit 40 is fittable into clearance spaces in the hoistway and does not require the construction of a machine room.

Figure 7:
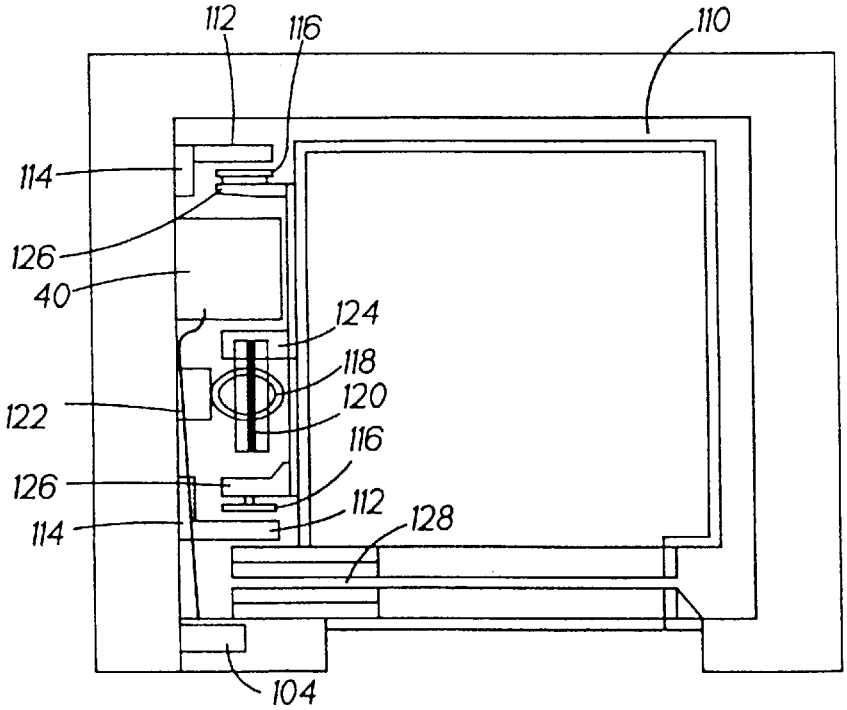
FIG. 7 is a top plan view of a hoistway illustrating an alternate location for the hydraulic pump unit.

Another embodiment of the invention is illustrated in FIG. 7 from a top plan view. In this embodiment the power unit 40 is located at the side of the elevator car 110 between guide rails 112 and brackets 114. One of skill in the art will appreciate the otherwise conventional aspects of the drawing which include rollers or sliding shoes 116; piston 118; pully 120; piston bracket 122; ropes fixing plate 124; uprights 126 and car doors 128.

Another feature of the invention significantly improves the convenience of a rescue hand pump by locating the same in a control cabinet 130 near the elevator door on one of the floors serviced by the elevator system. The location avoids the need to enter the hoistway and additionally will allow for a visual confirmation of location of elevator car 42 by the person operating the hand pump. To enable the benefits of this aspect of the invention reference is made to FIGS. 2 and 6. Within control cabinet 130 is auxiliary block 104 including a hand pump 132 for lifting the elevator car to a next higher floor and, alternatively, a valve 134 to allow fluid in the elevator piston to move back into the reservoir to allow the elevator car to descend to the next floor. In order to so locate the auxiliary valve block 104, hoses 106 and 108 are provided as shown. In addition hereto, and because of the remote location of the pump 132 provision must be made for priming the pump during installation thereof. Expediently, this is provided for by a three way valve located at the interface between hose 106 and valve block 80 which can be positioned to pump fluid into hose 106 and back through hose 108 for initial priming. This is done by signaling an elevator car call with the valve in the prime position. Fluid pressurized by the pump will thus be urged through the hoses 106 and 108 and through the auxiliary block 104. Subsequent to this operation the valve is set to normal operation and it does not need to be activated again unless disassembly of the rescue pump assembly is necessary for maintenance or repair.

Although the invention has been shown and described with respect to exemplary embodiments thereof; it should be understood by those skilled in the art that various changes, omissions, and additions may be made thereto, without departing from the spirit and scope of the invention.

What is claimed is:

1. An hydraulic elevator power unit comprising:

a vertically oriented elongated outer tank;

a motor taken mounted within said outer tank;

a motor disposed within said motor tank; and a pump operably connected to said motor.

2. A hydraulic elevator power unit as claimed in claim 1 wherein said unit further comprises a valve block mounted to said outer tank.

3. A hydraulic elevator power unit as claimed in claim 2 wherein said unit includes an insulative cover disposed over said valve block.

4. A hydraulic elevator power unit as claimed in claim 1 wherein said unit further includes at least one fluid path from said valve block to said motor tank.

5. A hydraulic elevator power unit as claimed in claim 1 wherein said unit contains a hydraulic fluid whose level is variable within said outer tank and is fixed within said motor tank.

* * * * *